US012091917B2

(12) United States Patent
Chen

(10) Patent No.: US 12,091,917 B2
(45) Date of Patent: Sep. 17, 2024

(54) SHAPED CUTTER WITH PERIPHERAL CUTTING TEETH AND TAPERED OPEN REGION

(71) Applicant: Halliburton Energy Services, Inc., Houston, TX (US)

(72) Inventor: Shilin Chen, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 104 days.

(21) Appl. No.: 17/956,659

(22) Filed: Sep. 29, 2022

(65) Prior Publication Data

US 2024/0110447 A1 Apr. 4, 2024

(51) Int. Cl.
*E21B 10/55* (2006.01)
*E21B 10/567* (2006.01)

(52) U.S. Cl.
CPC ..... *E21B 10/5673* (2013.01)

(58) Field of Classification Search
CPC ..... E21B 10/5673; E21B 10/5676
See application file for complete search history.

(56) References Cited

U.S. PATENT DOCUMENTS 4,984,642 A * 1/1991 Renard ..... E21B 10/5673 175/430
6,196,910 B1 * 3/2001 Johnson ..... B23B 27/143 451/542
6,626,167 B2 * 9/2003 Kim ..... B24D 18/00 451/540
D581,958 S * 12/2008 Morozov ..... D15/139
7,658,666 B2 * 2/2010 Sung ..... B24B 53/12 451/443
8,025,107 B2 9/2011 Drivdahl et al.
8,327,956 B2 12/2012 Drews et al.
(Continued)

FOREIGN PATENT DOCUMENTS

WO 2007127680 11/2007
WO 2021041753 3/2021

OTHER PUBLICATIONS

Xie, Dou; Huang, Zhiqiang; Yan, Yuqi; Ma, Yachao; Yuan, Yuan (2020). Application of an innovative ridge-ladder-shaped polycrystalline diamond compact cutter to reduce vibration and improve drilling speed. Science Progress, 103(3), 003685042093097—.
(Continued)

*Primary Examiner* — Blake Michener
(74) *Attorney, Agent, or Firm* — Michael Jenney; C. Tumey Law Group PLLC

(57) ABSTRACT

A shaped cutter has a plurality of peripheral cutting teeth to enhance drilling. The shaped cutter may enhance rock failure modes in addition to shearing, such as by indentation, impacting, scraping and grinding. The peripheral cutting teeth are located along the periphery, where cutting energy and forces may be highest. An open region radially inward of the peripheral cutting teeth may be axially recessed to increase the proportion of cutting load on the peripheral cutting teeth. The cutting table may be tapered to modify a back rake angle. The flared periphery may result in a sharper indentation angle and/or larger radius of contact. The plurality of cutting teeth may also exploit vibrations in the drill string to enhance rock failure.

20 Claims, 6 Drawing Sheets

(56) References Cited

U.S. PATENT DOCUMENTS

| | | | | |
|---|---|---|---|---|
| 8,833,492 | B2 | 9/2014 | Durairajan et al. | |
| 8,851,206 | B2 | 10/2014 | Patel | |
| 11,098,532 | B2 | 8/2021 | Gan et al. | |
| 11,215,012 | B2 | 1/2022 | Chen et al. | |
| D1,006,074 | S * | 11/2023 | Fang | D15/139 |
| 2008/0264696 | A1* | 10/2008 | Dourfaye | E21B 10/573 175/428 |
| 2015/0368981 | A1* | 12/2015 | Jiang | E21B 10/567 175/428 |
| 2018/0318962 | A1* | 11/2018 | Zhao | B23K 26/361 |
| 2019/0071933 | A1* | 3/2019 | Gan | E21B 10/5671 |
| 2019/0203539 | A1* | 7/2019 | Zhao | E21B 10/5673 |
| 2019/0338599 | A1* | 11/2019 | Bellin | E21B 10/55 |
| 2019/0376346 | A1* | 12/2019 | Vijayabalan | E21B 10/46 |
| 2020/0347680 | A1 | 11/2020 | Tian et al. | |
| 2021/0009426 | A1* | 1/2021 | Fang | C01B 32/25 |
| 2022/0003046 | A1 | 1/2022 | Yu et al. | |
| 2023/0417109 | A1* | 12/2023 | Zhang | E21B 10/5673 |

OTHER PUBLICATIONS

Development and Verification of Triple-Ridge-Shaped Cutter for PDC Bits, Shao, et al., SPE Journal, 2022.

* cited by examiner

SHAPED CUTTER WITH PERIPHERAL CUTTING TEETH AND TAPERED OPEN REGION

BACKGROUND

Wells are constructed in subterranean formations in an effort to extract hydrocarbon fluids such as oil and gas. A wellbore may be drilled with a rotary drill bit mounted at the lower end of a drill string. The drill string is assembled at the surface of a wellsite by progressively adding lengths of tubular drilling pipe to reach a desired depth. The drill bit is rotated by rotating the entire drill string from the surface of the well site and/or by rotating the drill bit with a downhole motor incorporated into a bottomhole assembly (BHA) of the drill string. As the drill bit rotates against the formation, cutters on the drill bit disintegrate the formation in proximity to the drill bit. Drilling fluid ("mud") is circulated through the drill string and the annulus between the drill string and the wellbore to lubricate the drill bit and remove cuttings and other debris to surface.

Rotary drill bits are generally categorized as fixed cutter (FC) bits having discrete cutters secured to a bit body at fixed positions (i.e., fixed cutters), roller cone (RC) bits having rolling cutting structures (i.e., roller cones), or hybrid bits comprising both fixed cutters and rolling cutting structures. A fixed cutter is typically secured to the bit body with the cutting table at a particular orientation and position, thereby exposing some portion of the cutting table to the formation. A fixed cutter traditionally has a cylindrical overall shape with a round, flat cutting table. However, as diamond manufacturing continues to improve, more nuanced cutting table shapes continue to be developed that provide various technical advantages.

BRIEF DESCRIPTION OF THE DRAWINGS

These drawings illustrate certain aspects of some examples of the present disclosure and should not be used to limit or define the disclosure.

DETAILED DESCRIPTION

Various shaped cutters are disclosed for use on a drill bit or other wellbore forming tool. The shaped cutters may be fixed cutters, formed as a polycrystalline diamond compact (PDC) utilizing one or more high-pressure, high-temperature press cycle. The design of the disclosed shaped cutter includes various functional aspects to enhance rock removal while drilling. The shaped cutter may cut rock by shearing, and by virtue of its shape, may also enhance other rock failure modes, including but not limited to indentation, impacting, scraping and grinding. In one aspect, the shaped cutter includes multiple peripheral cutting teeth on the cutter face to increase a stress level to the rock. The plurality of peripheral cutting teeth may generate multiple cracks in the formation. The cutter geometry may also modify a back rake angle for the cutter engaging the formation as compared with the back rake angle of a conventional cylindrical cutter at the same relative orientation on the bit body. The cutter geometry may also provide a sharper indentation angle than would otherwise be present in a conventional cutter.

The shape of the disclosed cutters may also make productive use of the presence of vibrations in the drill string, which may include both torsional and axial vibration components. Aspects of the disclosed cutter designs were conceived, in part, on a recognition that a PDC bit has almost always some type of vibration in drilling, especially in relatively hard formations. Vibration in a cutting direction may help the teeth to generate more cracks in the formation in front of the teeth. Energy may be distributed over the multiple cracks to increase a frequency and/or reduce an amplitude of a vibration frequency while drilling. Torsional vibrations propagating to a drill bit may be used to enhance cutting with the use of a non-planar (e.g., tapered) cutter surface at locations where a conventional cutter may otherwise have a planar surface. Axial vibrations propagating to the drill bit may also be used to enhance cutting with a sharper cutting angle to increase cutter indentation.

Figure 1:
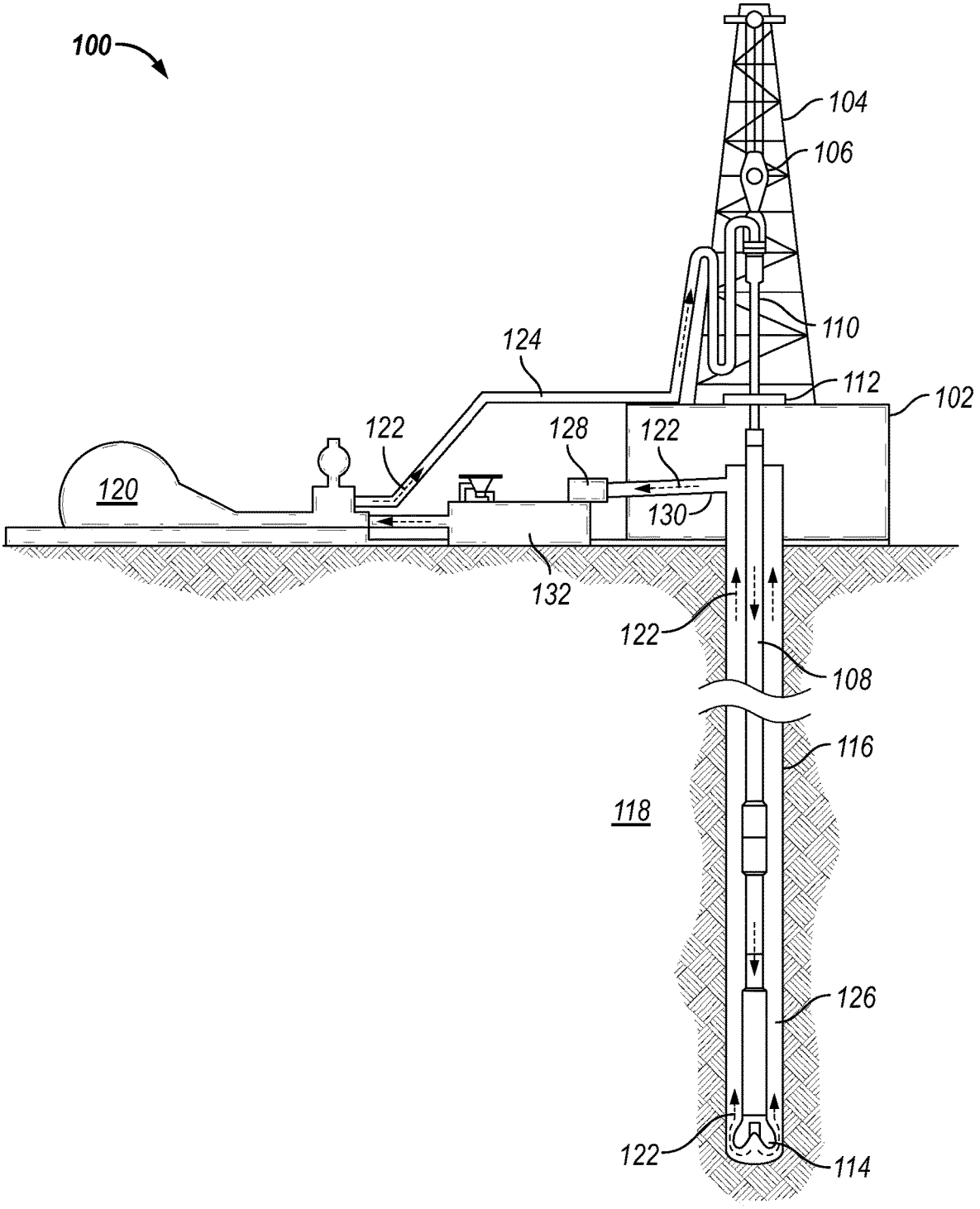
FIG. 1 is an elevation, partially cross-sectional view of a representative well site at which a wellbore may be formed by drilling and other operations.

FIG. 1 is an elevation, partially cross-sectional view of a representative well site at which a wellbore may be formed by drilling and other operations. While FIG. 1 generally depicts land-based drilling, the principles described herein are applicable to subsea drilling operations that employ floating or sea-based platforms and rigs, without departing from the scope of the disclosure. As illustrated, a drilling rig 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A rotary drill bit 114 is attached to the distal end of the drill string 108 and may be rotated by via rotation of the drill string 108 from the well surface and/or a downhole motor. The drill bit 114 is a wellbore forming tool that is used to initially form a wellbore 116 in a subterranean formation 118. Other wellbore forming tools may be included on the drill string for use in certain drilling operations, such as one or more hole opener and/or reamer to selectively widen a portion of the wellbore 116, or a coring bit used to obtain and retrieve a sample of the formation for analysis.

The drill bit 114 may be a fixed-cutter or hybrid drill bit having one or more fixed cutters, including one or more shaped cutters as disclosed herein to enhance rock removal. A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (i.e., a mud pit). While illustrated as being arranged at the outlet of the wellbore 116 via the annulus 126, those skilled in the art will readily appreciate that the fluid processing unit(s) 128 may be arranged at any other location in the drilling rig 100 to facilitate its proper function, without departing from the scope of the scope of the disclosure.

Figure 2:
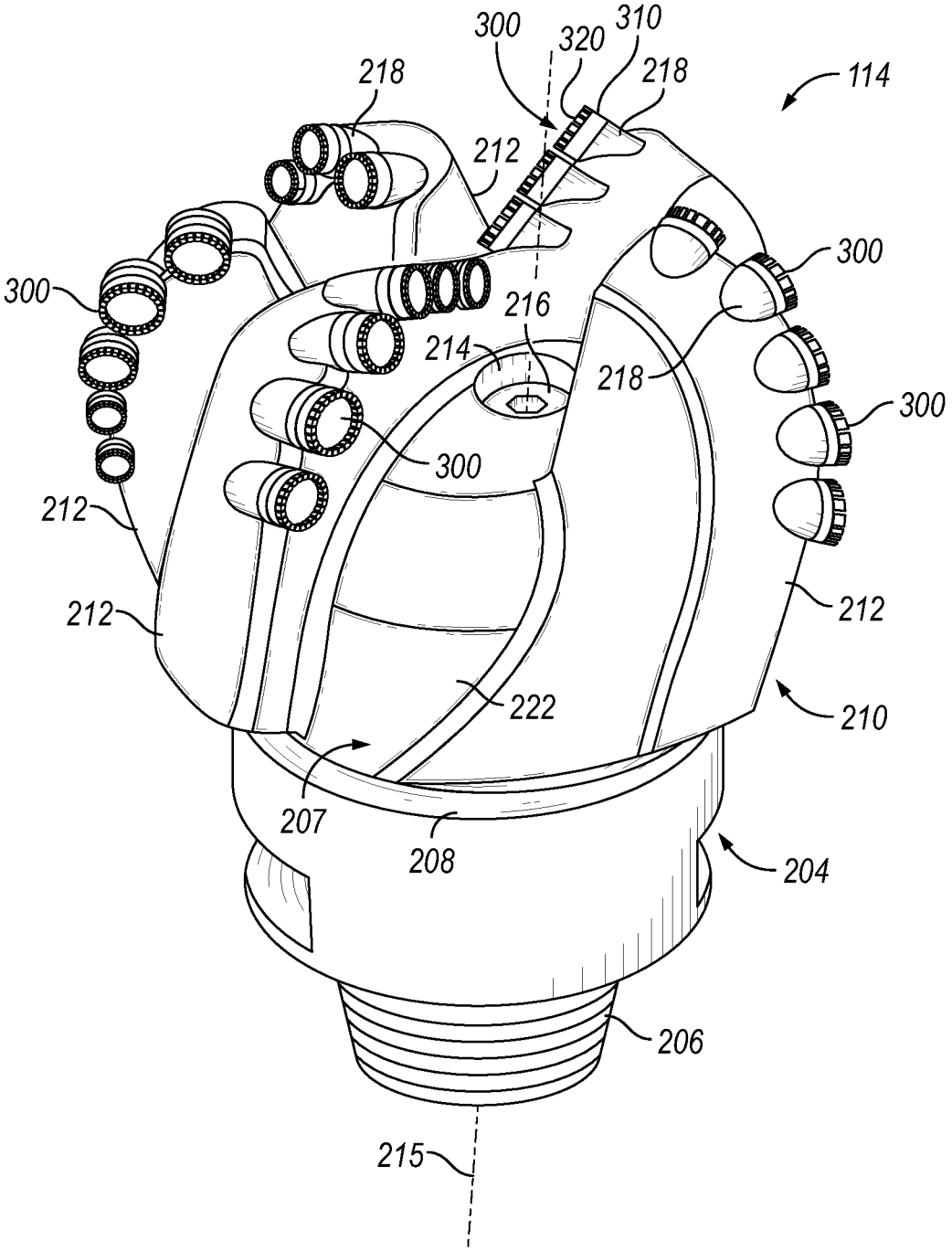
FIG. 2 is a perspective view of a drill bit as an example of a wellbore forming tool that may use the disclosed shaped cutters.

FIG. 2 is a perspective view of the drill bit 114 as an example of a wellbore forming tool that may employ shaped cutters and other aspects of the present disclosure. The drill bit 114 includes a rigid bit body 210 to which a plurality of fixed cutters may be secured, of which one or more may be a disclosed shaped cutter. In some embodiments, the bit body 210 may be formed by a metal-matrix composite, such as tungsten carbide reinforcing particles dispersed in a binder alloy. The bit body 210 includes a plurality of blades 212 formed on the exterior of the bit body 210. The blades 212 may be spaced from each other to form fluid flow paths or junk slots 222 therebetween. A plurality of cutter pockets 218 are formed on the blades 212 to receive cutters at predetermined positions. As illustrated, all of the cutters are shaped cutters 300 according to this disclosure. However, other embodiments may include one or more of the shaped cutters 300 in combination with other cutters, such as conventional round/flat cutters or other cutter shapes. Each shaped cutter 300 includes a substrate 310 and a cutting table 320 secured to the substrate 310. The substrate 310 is received by the respective cutter pocket 218 and secured within the cutter pocket 218 such as by brazing.

The bit body defines a bit axis 215 about which the drill bit 114 may rotate while drilling. The bit axis 215 may coincide at least approximately with a center of mass of the drill bit 114. The bit axis 215 may be generally aligned with an axis of a drill string or other conveyance to which the drill bit 114 is coupled. Drill bits may be connected in any of an unlimited number of ways to a drill string, coiled tubing, or other conveyance to allow for rotation about the bit axis 215. In this example, the drill bit 114 may include a metal shank 204 with a mandrel or metal blank 207 securely attached thereto (e.g., at weld location 208). The metal blank 207 extends into bit body 210. The metal shank 204 includes a threaded connection 206 distal to the metal blank 207 for securing the drill bit 114 to a drill string, which connection may generally align the bit axis 215 with an axis of the drill string or other desired axis of rotation.

While drilling, an axial force such as weight on bit (WOB) may be applied in a direction of the bit axis 215, such that the cutters 300 engage the formation being drilled. Simultaneously, the drill bit 114 is rotated about the bit axis 215 to engage the earthen formation to cut material ("rock") from the formation. The shaped cutters 300 have particular shapes, such as disclosed below in specific examples, that may enhance the removal of rock while drilling. Drilling fluid circulated downhole may lubricate the drill bit 114 and remove the cuttings and other fluid contaminants to the surface, such as generally described above in relation to FIG. 1. A nozzle 216 may be positioned in each nozzle opening 214 and positioned to clear cuttings/chips of formation material from the shaped cutters 300 through evacuation features of the bit 114, including junk slots 222.

Figure 3:
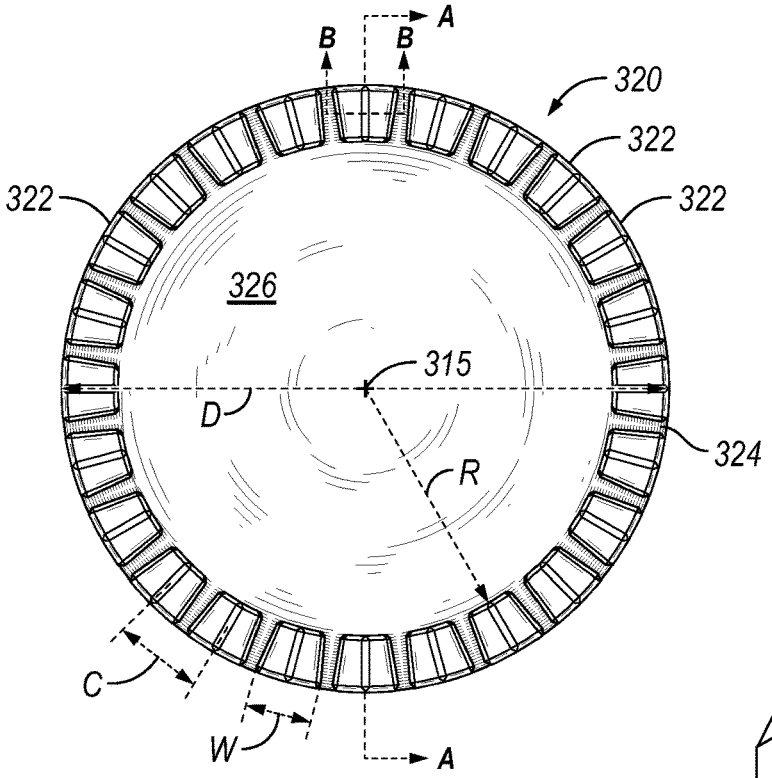
FIG. 3 is a plan view of a cutting table of a shaped cutter according to one example arrangement of peripheral cutting teeth.

FIG. 3 is a plan view of a cutting table 320 of a shaped cutter. A cutter axis 315 extending through the center of the cutting table 320 (perpendicular to the page) may provide a geometrical reference for discussing certain features of the cutting table 320. The cutting table 320 has a plurality of peripheral cutting teeth 322 circumferentially arranged along a periphery 324 of the cutting table 320 about the cutter axis 315. Twenty four peripheral cutting teeth 322 are evenly spaced along the periphery 324, although other embodiments may have a different size, shape, spacing, and/or number of peripheral cutting teeth. The peripheral cutting teeth 322 extend radially all the way to the periphery 324 and may define at least a portion of the periphery 324, which may coincide with a circumference of a generally circular cutter profile. The large number of peripheral cutting teeth 322 may generate multiple cracks in the formation and distribute energy over the multiple cracks to increase a frequency and/or reduce an amplitude of a vibration frequency while drilling.

The peripheral cutting teeth 322 are equidistant from the cutter axis 315 at a radius "R" and are equally spaced circumferentially at a tooth spacing "C." The tooth spacing C is illustrated as a center-to-center tooth spacing in this example. The peripheral cutting teeth 322 may taper inwardly as shown in a radial direction toward the center of the cutting table coinciding with the cutter axis 315. Thus, a circumferential tooth width "W" according to the taper decreases from the outer portion of the peripheral cutting teeth 322 to the inner portion of the peripheral cutting teeth 322 at the radius R.

A portion of the cutting table 320 radially inward of the peripheral cutting teeth 322 is an open region 326 having no cutting teeth. The open region 326 is a generally circular region of radius R that traverses the cutter axis 315 and fully spans the portion of the cutting table 320 radially inward of the peripheral cutting teeth 322. In at least some embodiments, the open region 326 may span at least seventy percent of an overall cutter diameter D and may occupy at least fifty percent of a projected circular surface area ($\sim\pi/4*D^2$) of the cutter. This relatively small proportion of the total cutter diameter and surface area occupied by the peripheral cutting teeth 322 helps to heighten the indentation force of the cutting table 320 on the formation.

All or at least a majority of the open region 326 may be recessed axially (into the page of FIG. 3) with respect to the peripheral cutting teeth 322. This axially recessed aspect may ensure that more of a cutter loading on that cutter is supported by one or more of the peripheral cutting teeth 322 rather than being distributed over a wider area of the cutting table 320 inward of the peripheral cutting teeth 322. Positioning the peripheral cutting teeth 322 at the periphery (away from the cutter axis 315) also places the peripheral cutting teeth 322 in a region where cutting energy and forces are higher than cutting forces and energy would be further radially inward on the cutting table 320. As will be further discussed below, at least a portion of the open region 326 may be concave, tapering axially inwardly (into the page of FIG. 3). The taper in this context may include but is not limited to a frustoconical shape.

Figure 4:
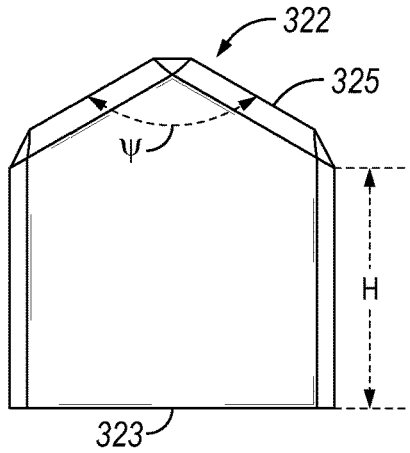
FIG. 4 is a cross-sectional view of a representative peripheral cutting tooth taken along section line B-B in FIG. 3.

FIG. 4 is a cross-sectional view of a representative peripheral cutting tooth 322 taken along section line B-B in FIG. 3. Various example tooth geometry is provided, along with some preferred ranges for geometrical parameters, although other suitable geometry and values may be considered within the scope of this disclosure. For example, a ridge angle "ψ" is defined that is preferably within a range of between 90 to 160 degrees. A radius "r" of the ridge is preferably within a range of 0.005 to 0.020 inches (0.127 to 0.51 mm). A height "H" from a base 323 of the tooth to where a tooth taper 325 begins is preferably in a range of between 0.15 to 0.4 inches (3.81 to 10.2 mm).

Figure 5:
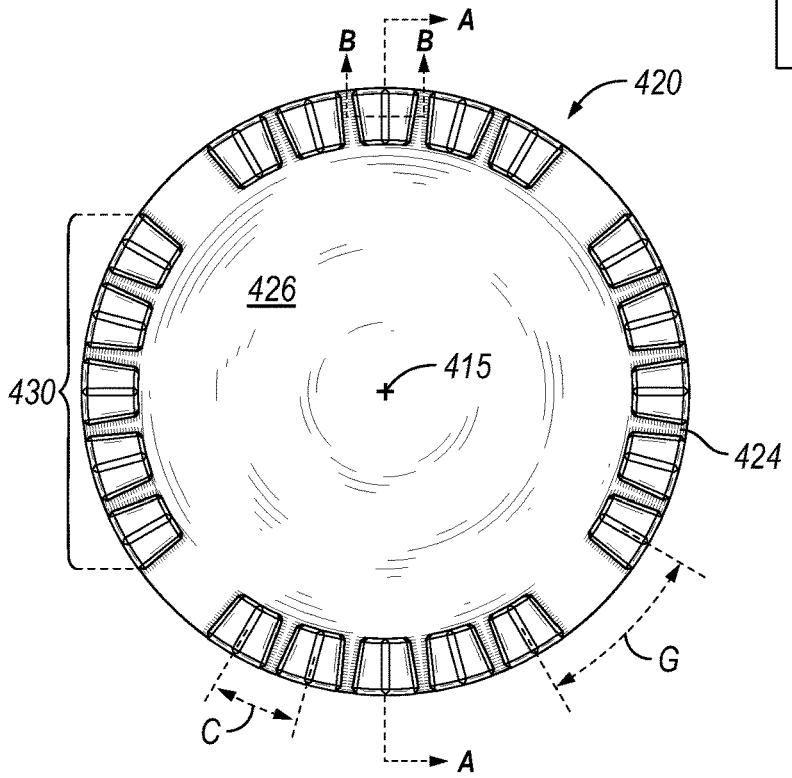
FIG. 5 is a plan view of a cutting table of a shaped cutter according to another example configuration having a different arrangement of peripheral cutting teeth.

FIG. 5 is a plan view of a cutting table 420 of a shaped cutter according to another example configuration having a different arrangement of peripheral cutting teeth 422. A cutter axis 415 extending through the center of the cutting table 420 (perpendicular to the page) may provide a geometrical reference for discussing certain features of the cutting table 420. The cutting table 420 has a plurality of peripheral cutting teeth 422 circumferentially arranged along a periphery 424 of the cutting table 420 about the cutter axis 415. Twenty peripheral cutting teeth 422 are included in this example, although other embodiments may have a fewer or greater number of peripheral cutting teeth. The peripheral cutting teeth 422 are arranged in a plurality of teeth groupings 430. This example has four teeth groupings 430 having five peripheral cutting teeth 422 per teeth grouping 430, although other embodiments may have different numbers of teeth groupings and/or teeth per teeth grouping. Preferably, any given embodiment has at least three teeth groupings 430 and at least three peripheral cutting teeth 422 per teeth grouping.

The peripheral cutting teeth 422 in each teeth grouping 430 optionally have an equal circumferential tooth spacing "C" between adjacent teeth in that group. Optionally, the circumferential tooth spacing C is the same in all of the teeth groupings 430. A group spacing "G" between adjacent teeth groupings is greater than the circumferential tooth spacing C in each of the adjacent teeth groupings. By this convention, the group spacing G and tooth spacing C in the figure are measured as the center-to-center distance of the respective teeth whose spacing is measured. However, the group spacing and tooth spacing could alternatively be measured as the closest points on the respective teeth being compared.

Aside from differences in the arrangement of the peripheral cutting teeth 422, other aspects of the cutting table 420 may be similar to aspects of the cutting table 320 of FIG. 3. For example, similar observations regarding the recessing of the open region 426, the proportion of the surface area occupied by the peripheral cutting teeth 422 and their peripheral placement, the optionally concave open region 426, and other aspects may also apply to the peripheral cutting teeth 422 of FIG. 5.

Figure 6:
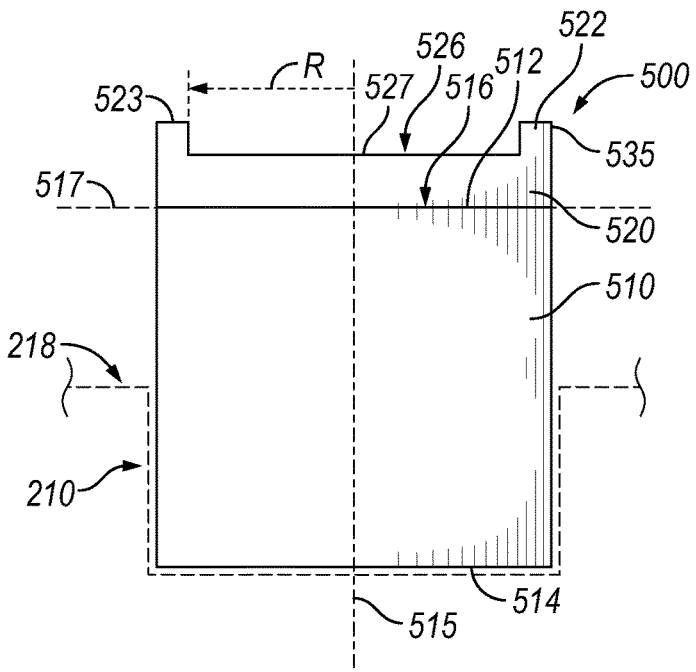
FIG. 6 is a cross-sectional side view of a shaped cutter according to an example configuration having a non-tapered open region.
Figure 6A:
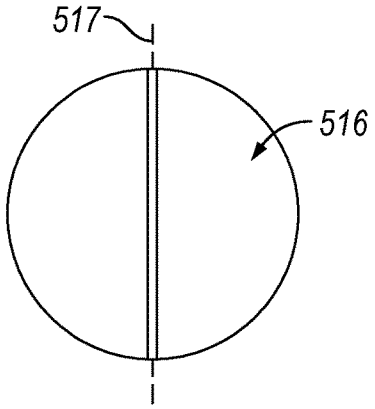
FIG. 6A is a view of a generally planar cutter-substrate interface.
Figure 6B:
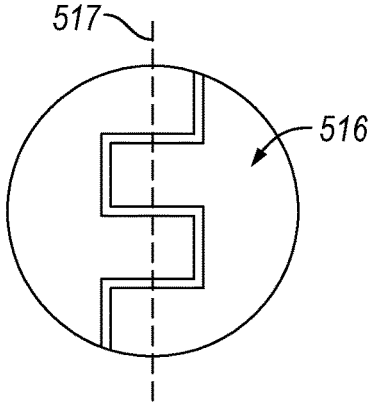
FIG. 6B is a view of a non-planar cutter-substrate interface.

FIG. 6 is a cross-sectional side view of a shaped cutter 500 according to an example configuration. The shaped cutter includes a substrate 510 having a proximal end 512 and a distal end 514 and defining a cutter axis 515 passing through the proximal and distal ends 512, 514. The cutter 500 is normally received into the cutter pocket 218 at the distal end 514 of the substrate 510. A shaped cutting table 520 is secured to the proximal end 512 of the substrate at a cutter-substrate interface 516. The cutter-substrate interface 516 may be generally planar, defining a transverse plane, optionally orthogonal to the cutter axis 515 as depicted in FIG. 6A, or it may be non-planar, such as depicted schematically in FIG. 6B. In either case, an interface plane 517 aligned with the cutter-substrate interface 516, and which may be transverse and perpendicular to the cutter axis 515, may be used for referencing certain geometrical features, such as one or more axial distances with respect to the reference plane 517. The cutting table has a cutting end 532 on which a plurality of peripheral cutting teeth 522 are arranged. The peripheral cutting teeth 522 are schematically depicted here but may have the shape of the peripheral cutting teeth 322 or 422 or any another suitable tooth shape. The cutting end 532 is exposed in the sense that it is opposite the cutter-substrate interface 516 and some part of the cutting end 532 may come into contact with the formation depending on the particular orientation at which the cutter 500 is fixed to the bit body 210.

The peripheral cutting teeth 522 may be arranged according to the examples of FIG. 3, FIG. 4, or some other arrangement within the scope of this disclosure. The peripheral cutting teeth 522 are equidistant from the cutter axis 515 at the radius R. An open region 526 spans a portion of the cutting table 520 radially inward of the peripheral cutting teeth 522. The entirety of the open region 526 in this example is a flat, interior surface 527 orthogonal to the cutter axis 515. The open region 526 is also recessed with respect to the peripheral cutting teeth 522, and a top surface 523 of the peripheral cutting teeth 522 extends a distance above the flat, interior surface 527 of the open region 526. The peripheral cutting teeth 522 extend parallel to the cutter axis 515 in an axial direction away from the cutter-substrate interface. The shaped cutter 700 may be secured to the bit body at an orientation whereby a cutting edge indicated at 535 makes initial contact the formation during drilling. The cutting edge 535 may have a chamfer size in the range of 0.005 to 0.020 inch.

Figure 7:
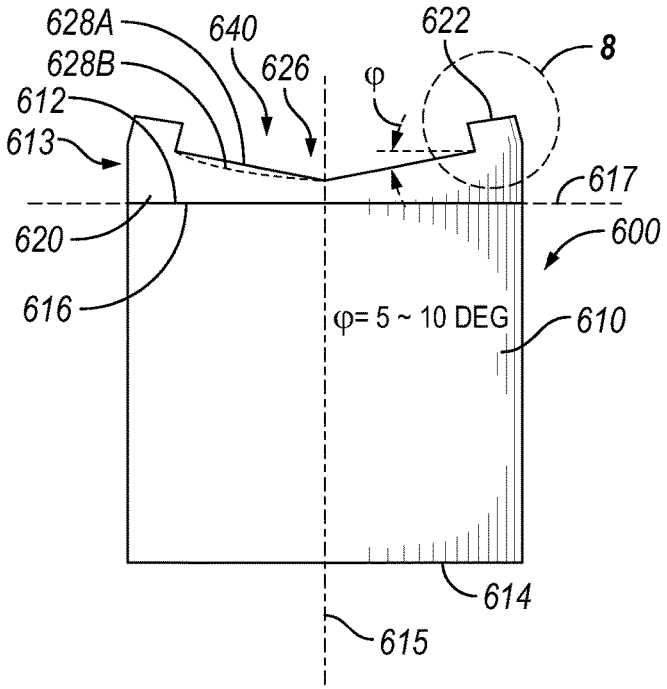
FIG. 7 is a cross-sectional side view of a shaped cutter according to another example configuration having a tapered open region.

FIG. 7 is a cross-sectional side view of a shaped cutter 600 according to another example configuration. The shaped cutter includes a substrate 610 having a proximal end 612 and a distal end 614 and defining a cutter axis 615 passing through the proximal and distal ends 612, 614. A shaped cutting table 620 is secured to the proximal end 610 of the substrate at a cutter-substrate interface 616. An interface plane 617 aligned with the cutter-substrate interface 616 is transverse and perpendicular to the cutter axis 615. The cutting table 620 has a cutting end 632 on which a plurality of peripheral cutting teeth 622 are arranged. The peripheral cutting teeth 622 are schematically depicted here but may have the shape of the peripheral cutting teeth 322 or 422 or any another suitable tooth shape.

The peripheral cutting teeth 622 are equidistant from the cutter axis 615. The open region 626 is recessed with respect to the peripheral cutting teeth 622. The open region 626 comprises a tapered portion 628A that is non-orthogonal to the cutter axis 615. In this case, the tapered portion 628A extends all the way from the peripheral cutting teeth 622 toward the cutter axis 615 at an internal back rake angle φ with respect to the interface plane 617. The internal back rake angle φ is preferably within a range of between five to ten degrees in one or more embodiments, although an angle outside this range is also within the scope of this disclosure. Alternative embodiments may have an open region in which one portion is perpendicular to the cutter axis 616 and another portion is tapered. The taper 628A results in a concavity, in that the taper 628A extends axially inwardly in a radial direction towards the cutter axis 616. In this case the open region 626 is generally frustoconical, wherein the taper 628A extends linearly in the radial direction toward the cutter axis 616. However, a concavity with a curved profile in the radial direction toward the cutter axis 616, such as shown in dashed lines at 628B, may alternatively be formed in the open region 626.

Figure 8:
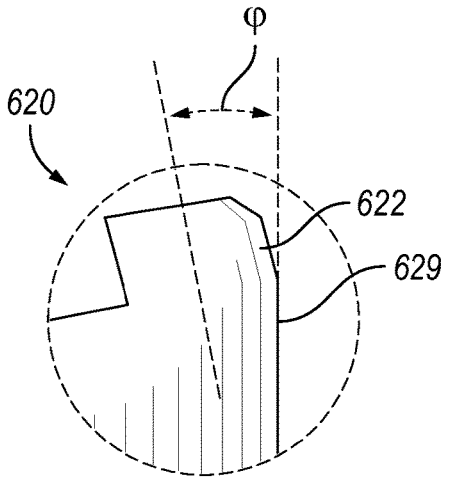
FIG. 8 is an enlarged view of the detail encircled at "8" in FIG. 7.

FIG. 8 is an enlarged view of the detail encircled at "8" in FIG. 7. The cutting table 620 includes a generally cylindrical outer profile 629 that may extend from below the peripheral cutting teeth 622. Optionally, as shown, the cylindrical outer profile 629 of the cutting table 620 matches the cylindrical profile of the substrate 610, resulting in a cylindrical profile all the way down to the distal end 614 of the shaped cutter 600 (FIG. 7). The peripheral cutting teeth 622 are angled radially inwardly. In particular, the peripheral cutting teeth 622 extend perpendicular to the taper 628A at an angle equal to the internal back rake angle φ with respect to the cutter axis 615 and with respect to the generally cylindrical outer profile 629.

Figure 9:
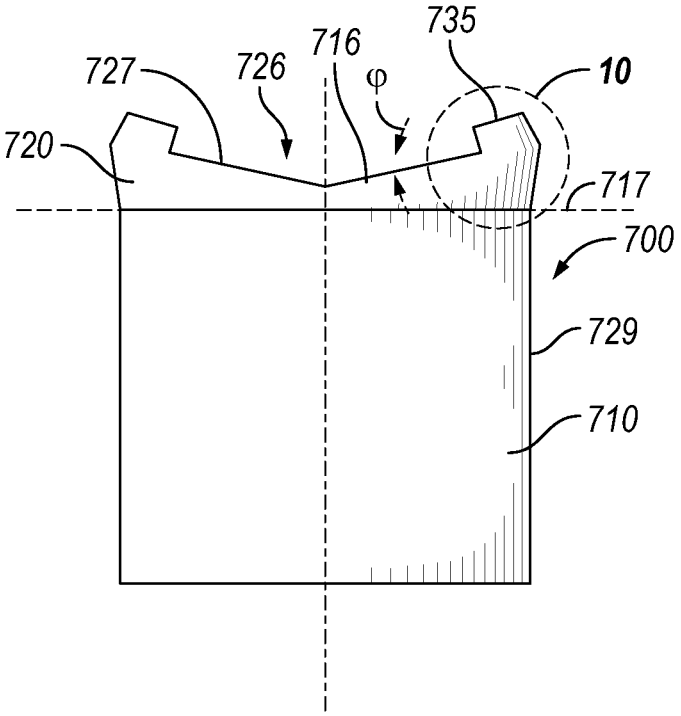
FIG. 9 is a cross-sectional side view of a shaped cutter according to another example configuration having outwardly flared periphery and inwardly angled peripheral cutting teeth.

FIG. 9 is a cross-sectional side view of a shaped cutter 700 according to another example configuration. The shaped cutter 700 is similar in some respects to the shaped cutter of FIG. 8 but has a modified cutting table 720, particularly at the portion encircled at 10 and shown in the enlarged detail view of FIG. 10. Like the example of FIG. 7, the cutting table 720 in FIG. 9 includes an open region 726 that comprises a tapered interior surface 727 with an internal back rake angle φ with respect to a horizontal interface plane 717. The peripheral cutting teeth 722 again extend perpendicular to the taper 728A, which orients the peripheral cutting teeth 722 at an angle equal to the internal back rake angle φ with respect to the cutter axis 715. The substrate 710 includes a generally cylindrical outer profile 629.

Figure 10:
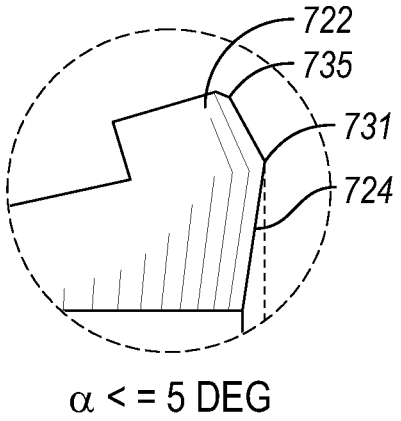
FIG. 10 is an enlarged detail view of a portion of the cutter encircled at "10" in FIG. 9.

However, as better seen in the enlarged detail view of FIG. 10, the cutting table 720 includes a periphery 724 defining non-cylindrical outer profile between the peripheral cutting teeth 722 and the cutter-substrate interface 716. Instead, the periphery 724 of the cutting table 720 flares radially outwardly, thereby defining a generally frustoconical surface. This outwardly flared periphery 724 provides a knuckle 731 of the cutting table 720 having a larger outer diameter (OD) than an OD of the substrate 710. As compared with the design of FIGS. 7 and 8, this increases the radius of the peripheral cutting teeth 722 and the corresponding cutting energy and forces at the peripheral cutting teeth 722 where they contact the formation during drilling. In this example, this positions an outer cutting edge 735 of the peripheral cutting teeth 722 at about the same radius as the cutting edge 535 of the straight peripheral cutting teeth of FIG. 6. However, because the peripheral cutting teeth 722 are angled, this may also orient the cutting edge 735 for more aggressive contact with the formation.

Figure 11:
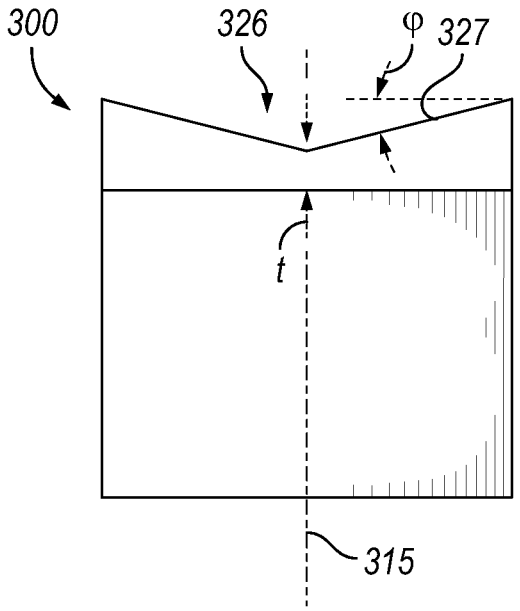
FIG. 11 is a schematic diagram of a shaped cutter with an open region that has a tapered profile extending all the way across the open region.
Figure 12:
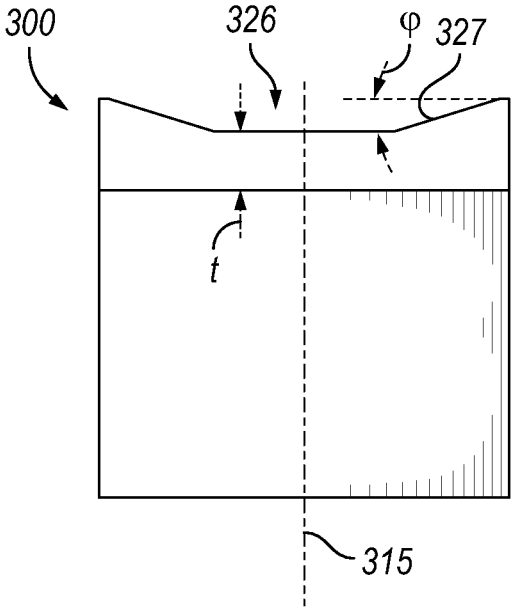
FIG. 12 is a schematic diagram of the shaped cutter wherein the tapered profile is only a portion of the open region.

FIGS. 11 and 12 are schematic diagrams of different shaped cutter cross-sections and examples profiles for the open region 326, omitting the peripheral cutting teeth. FIG. 11 is a schematic diagram of the shaped cutter 300 wherein the open region 326 includes a tapered profile 327 extending all the way from the teeth to the cutter axis 315 at the internal back rake angle (p. This is similar to the profile of the open regions 626 and 726 of FIGS. 7 and 9. FIG. 12 is a schematic diagram of the shaped cutter 300 wherein the tapered profile 327 instead extends only a portion of the way to the cutter axis 315 at the internal back rake angle cp. The open region 326 also includes a transverse, planar portion (i.e., defining a transverse plane) 329 radially inward of the tapered profile 327 orthogonal to the cutter axis 315. The tapered profile 327 of FIG. 12 may be shorter than in FIG. 11, but still long enough for an expected depth of cut (i.e., for scenarios wherein the formation is not expected to extend beyond the shortened tapered profile 327 of FIG. 12). The reduced length taper of FIG. 12 may reduce manufacturing costs and/or desirably increase the minimum thickness "t" and corresponding strength of the cutting table of FIG. 12 versus the minimum thickness t of the cutting table of FIG. 11. In addition, the reduced length taper may help to clean the cutter surface by drilling fluid to reduce cutter spalling. As can be further understood with respect to FIGS. 13 and 14, the profile of the open region 326 may affect cutter engagement and dynamics while drilling.

Figure 13:
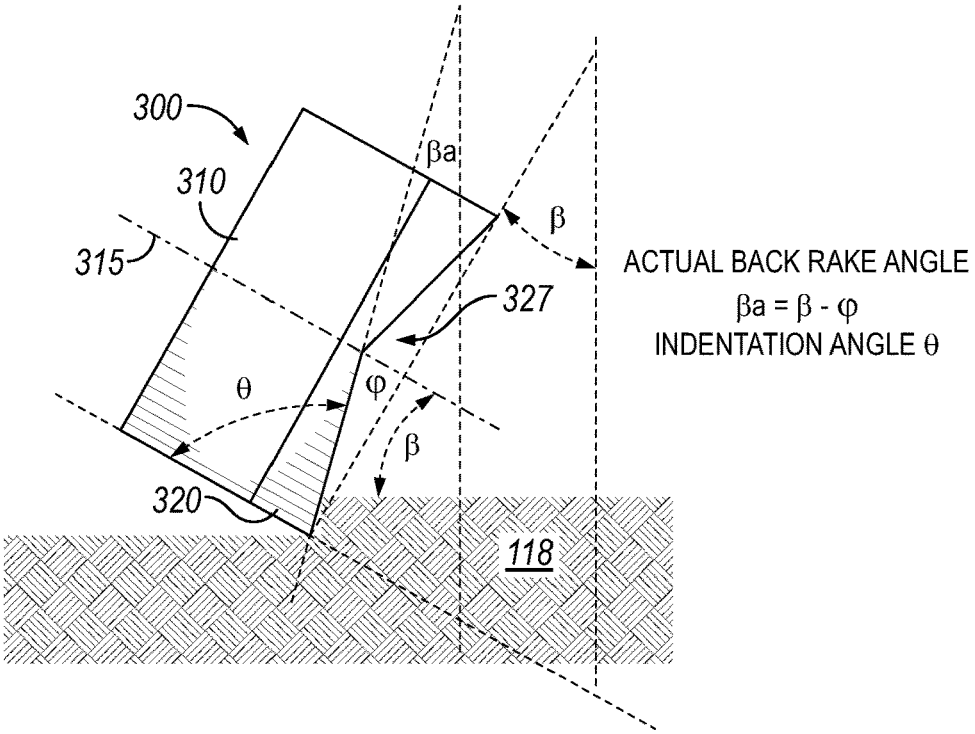
FIG. 13 is a schematic diagram of a shaped cutter with a tapered profile while the cutting table is engaging the formation during drilling.

FIG. 13 is a schematic diagram of a shaped cutter 300 with a tapered profile 327 similar to that of FIG. 11 while the shaped cutting table 320 is engaging the formation 118 during drilling. The cutter axis 315 is again oriented in the plane of FIG. 13 at an angle β with respect to the surface of the formation 118 being cut. Again, the internal back rake angle φ as described above reduces the effective (i.e., actual) back rake angle. Thus, the actual back rake angle $\beta a=\beta-\varphi$. The reduced actual back rake angle may increase cutting efficiency, especially in soft formations. This correspondingly reduces an indentation angle θ. The reduced indentation angle may also enhance cutting efficiency in soft formation.

Figure 14:
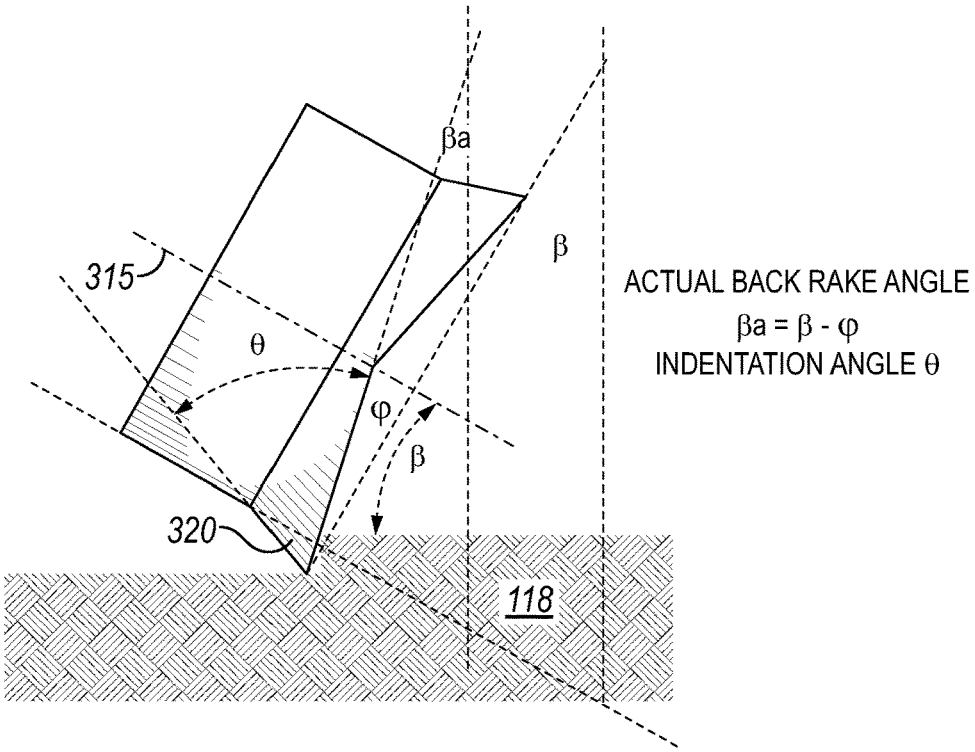
FIG. 14 is a schematic diagram of a shaped cutter having another tapered profile while engaging the formation during drilling.

FIG. 14 is a schematic diagram of a shaped cutter 300 having another tapered profile 327 while engaging the formation 118 during drilling. The cutter axis 315 is oriented in the plane of FIG. 13 at an angle β with respect to the surface of the formation 118 being cut. As illustrated, this angle β is generally the back rake angle of a conventional cutter with a round, flat cutting table. However, the internal back rake angle φ as described above again reduces the effective (i.e., actual) back rake angle. Thus, the actual back rake angle $\beta a=\beta-\varphi$, with an indentation angle θ.

However, the shaped cutting table 320 in FIG. 14 has a periphery 324 that flares radially outwardly, similar to that of FIGS. 9 and 10, thereby defining a generally frustoconical surface. This outwardly flared periphery 324 results in a sharper outer cutting edge 335 than in FIG. 13. The cutter geometry thereby provides a sharper indentation angle than would otherwise be present in a conventional cutter. The overall shape of the cutter may exploit the presence of vibrations in the drill string, which may include both torsional and axial vibration components. For example, torsional vibrations propagating to a drill bit may be exploited with a non-planar cutter surface at locations where a conventional cutter may otherwise have a planar surface. Axial vibrations propagating to the drill bit may also be exploited by the increased indentation angled in FIG. 14.

Therefore, a shaped cutter is disclosed along with a drill bit and a drilling method utilizing such a shaped cutter. The shaped cutter may include peripheral cutting teeth and an open region that is optionally tapered. The shaped cutter, drill bit and drilling method may include any combination of features including but not limited to those in the following examples.

Example 1. A shaped cutter for a wellbore forming tool, the shaped cutter comprising: a substrate having a proximal end and a distal end and defining a cutter axis passing through the proximal and distal ends; and a cutting table secured to the proximal end of the substrate at a cutter-substrate interface, the cutting table having a cutting end comprising a plurality of peripheral cutting teeth circumferentially arranged along a periphery of the cutting table equidistant from the cutter axis, and an open region spanning a portion of the cutting table radially inward of the peripheral cutting teeth.

Example 2. The shaped cutter of Example 1, wherein the open region defines a transverse plane orthogonal to the cutter axis that fully spans the portion of the cutting table radially inward of the peripheral cutting teeth.

Example 3. The shaped cutter of Example 1, wherein the open region comprises a tapered portion having an internal back rake angle from the peripheral cutting teeth toward the cutter axis.

Example 4. The shaped cutter of Example 3, wherein the tapered portion extends fully from the peripheral cutting teeth to the cutter axis.

Example 5. The shaped cutter of Example 3, wherein the tapered portion extends partially from the peripheral cutting teeth toward the cutter axis, and wherein the open region further comprises a transverse plane orthogonal to the cutter axis radially inward of the tapered portion of the open region.

Example 6. The shaped cutter of Example 3, wherein the internal back rake angle is within a range of between 5 to 10 degrees.

Example 7. The shaped cutter of Example 1, wherein the peripheral cutting teeth are arranged in a plurality of teeth groupings, with an equal circumferential tooth spacing between the peripheral cutting teeth in each teeth grouping, and with a group spacing between adjacent teeth groupings that is greater than the circumferential tooth spacing in each of the adjacent teeth groupings.

Example 8. The shaped cutter of Example 7, wherein the teeth groupings comprise at least three teeth groupings of three peripheral cutting teeth per teeth grouping.

Example 9. The shaped cutter of Example 7, having four teeth groupings of five peripheral cutting teeth per teeth grouping.

Example 10. The shaped cutter of Example 1, wherein the cutting table comprises an outer diameter equal to a diameter of the substrate.

Example 11. The shaped cutter of Example 1, wherein the periphery of the cutting table defines a generally cylindrical outer profile.

Example 12. The shaped cutter of Example 11, wherein the peripheral cutting teeth extend parallel to the cutter axis in an axial direction away from the cutter-substrate interface.

Example 13. The shaped cutter of Example 1, wherein the peripheral cutting teeth are angled radially inwardly.

Example 14. The shaped cutter of Example 13, wherein the periphery of the cutting table defines a generally frustoconical surface that flares radially outwardly in an axial direction away from the cutter-substrate interface.

Example 15. The shaped cutter of Example 13, wherein the periphery of the cutting table defines a generally frustoconical surface that flares radially inwardly in an axial direction away from the cutter-substrate interface.

Example 16. A drill bit comprising: a bit body comprising one or more blades each having one or more cutter pockets; one or more shaped cutters disposed in a respective one of the cutter pockets, each shaped cutter comprising a substrate having a proximal end and a distal end and defining a cutter axis passing through the proximal and distal ends, and a cutting table secured to the proximal end of the substrate at a cutter-substrate interface, the cutting table having a cutting end comprising a plurality of peripheral cutting teeth circumferentially arranged along a periphery of the cutting table equidistant from the cutter axis, and an open region spanning a portion of the cutting table radially inward of the peripheral cutting teeth.

Example 17. The drill bit of Example 16, wherein the bit body defines a bit axis about which the bit body rotates during drilling, and wherein at least one of the shaped cutters has an inwardly tapered surface defining an internal back rake angle and is secured to the bit body at an orientation that defines an actual back rake angle with the inwardly tapered surface of the cutting table.

Example 18. The drill bit of Example 17, wherein the inwardly tapered surface has an internal back rake angle of between 5 to 10 degrees.

Example 19. A drilling method, comprising: rotating a drill bit about a bit axis, the drill bit comprising a bit body with one or more blades each having one or more cutter pockets and one or more shaped cutters secured in a respective one of the cutter pockets, each shaped cutter comprising a substrate having a proximal end and a distal end and defining a cutter axis passing through the proximal and distal ends, and a cutting table secured to the proximal end of the substrate at a cutter-substrate interface, the cutting table having a cutting end comprising a plurality of peripheral cutting teeth circumferentially arranged along a periphery of the cutting table equidistant from the cutter axis, and an open region spanning a portion of the cutting table radially inward of the peripheral cutting teeth; and axially engaging a formation to be drilled with the drill bit while rotating the drill bit.

Example 20. The drilling method of Example 19, further comprising using the plurality of peripheral cutting teeth to simultaneously generate multiple cracks in the formation.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A shaped cutter for a wellbore forming tool, the shaped cutter comprising:

a substrate, comprising:

a proximal end;

a distal end; and an outer diameter, wherein the substrate defines a cutter axis passing through the proximal end and the distal end; and a cutting table secured to the proximal end of the substrate at a cutter-substrate interface, comprising:

a plurality of peripheral cutting teeth circumferentially arranged along a periphery of the cutting table equidistant from the cutter axis; and an open region spanning a portion of the cutting table radially inward of the plurality of peripheral cutting teeth, wherein the plurality of peripheral cutting teeth flare radially outward from the outer diameter to form a plurality of knuckles, respectively.

2. The shaped cutter of claim 1, wherein the open region defines a transverse plane orthogonal to the cutter axis that fully spans the portion of the cutting table radially inward of the peripheral cutting teeth.

3. The shaped cutter of claim 1, wherein the open region comprises a tapered portion having an internal back rake angle (φ) from the peripheral cutting teeth toward the cutter axis.

4. The shaped cutter of claim 3, wherein the tapered portion extends fully from the peripheral cutting teeth to the cutter axis.

5. The shaped cutter of claim 3, wherein the tapered portion extends partially from the peripheral cutting teeth toward the cutter axis, and wherein the open region further comprises a transverse plane orthogonal to the cutter axis radially inward of the tapered portion of the open region.

6. The shaped cutter of claim 3, wherein the internal back rake angle (φ) is within a range of between 5 and 10 degrees.

7. The shaped cutter of claim 1, wherein;

the peripheral cutting teeth are arranged in a plurality of teeth groupings, there is an equal circumferential tooth spacing between the peripheral cutting teeth within each teeth grouping of the plurality of teeth groupings, there is a group spacing between adjacent teeth groupings of the plurality of teeth groupings, and the group spacing is greater than the equal circumferential tooth spacing within each of the teeth groupings of the plurality of teeth groupings.

8. The shaped cutter of claim 7, wherein the teeth groupings comprise at least three teeth groupings of three peripheral cutting teeth per teeth grouping.

9. The shaped cutter of claim 7, having four teeth groupings of five peripheral cutting teeth per teeth grouping.

10. The shaped cutter of claim 1, wherein the periphery of the cutting table defines a generally cylindrical outer profile.

11. The shaped cutter of claim 10, wherein the peripheral cutting teeth extend parallel to the cutter axis in an axial direction away from the cutter-substrate interface.

12. The shaped cutter of claim 1, wherein outer cutting edges of the peripheral cutting teeth are angled radially inward.

13. The shaped cutter of claim 1, wherein the plurality of knuckles forms a second outer diameter circumscribing the shaped cutter.

14. The shaped cutter of claim 13, wherein the second outer diameter is greater than the outer diameter of the substrate.

15. The shaped cutter of claim 1, wherein the plurality of peripheral cutting teeth each have a tooth taper.

16. The shaped cutter of claim 15, wherein the tooth taper forms a ridge angle (Ψ) on each of the plurality of peripheral cutting teeth.

17. A drill bit comprising:

a bit body;

a blade disposed on the bit body;

a cutter pocket disposed on the blade; a shaped cutters disposed in the cutter pocket, comprising:

a substrate, comprising:

a proximal end;

a distal end; and an outer diameter, wherein the substrate defines a cutter axis passing through the proximal end and the distal end; and a cutting table secured to the proximal end of the substrate at a cutter-substrate interface, comprising:

a plurality of peripheral cutting teeth circumferentially arranged along a periphery of the cutting table equidistant from the cutter axis; and an open region spanning a portion of the cutting table radially inward of the plurality of peripheral cutting teeth, wherein the plurality of peripheral cutting teeth flare radially outward from the outer diameter to form a plurality of knuckles, respectively.

18. The drill bit of claim 17, wherein the bit body defines a bit axis about which the bit body rotates during drilling, and wherein at least one of the shaped cutters has an inwardly tapered surface defining an internal back rake angle (φ) and is secured to the bit body at an orientation that defines an actual back rake angle with the inwardly tapered surface of the cutting table.

19. The drill bit of claim 18, wherein the internal back rake angle (φ) is between 5 and 10 degrees.

20. A drilling method, comprising:

rotating the drill bit of claim 17 about a bit axis; and axially engaging a formation to be drilled with the drill bit while rotating the drill bit.

* * * * *